US007992535B2

(12) United States Patent
Steiner et al.

(10) Patent No.: US 7,992,535 B2
(45) Date of Patent: Aug. 9, 2011

(54) HEATING ENGINE OIL IN AN INTERNAL COMBUSTION ENGINE

(75) Inventors: Bernd Steiner, Bergisch Gladbach (DE); Kai Sebastian Kuhlbach, Bergisch Gladbach (DE); Jan Mehring, Cologne (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 12/892,184

(22) Filed: Sep. 28, 2010

(65) Prior Publication Data

US 2011/0079187 A1 Apr. 7, 2011

(30) Foreign Application Priority Data

Oct. 5, 2009 (DE) ..... 10 2009 045 320

(51) Int. Cl.
*F01M 5/00* (2006.01)

(52) U.S. Cl. ..... 123/196 AB; 184/104.2

(58) Field of Classification Search ..... 123/196 R, 123/196 AB; 184/104.2
See application file for complete search history.

(56) References Cited

U.S. PATENT DOCUMENTS 5,517,959 A * 5/1996 Kato et al. ..... 123/196 AB

FOREIGN PATENT DOCUMENTS

| | | | |
|---|---|---|---|
| DE | 2252705 | A1 | 5/1974 |
| DE | 20311703 | U1 | 11/2003 |
| DE | 2007060397 | | 6/2009 |
| JP | 61047437 | U | 3/1986 |
| JP | 61135911 | A | 6/1986 |
| JP | 1182560 | A | 7/1989 |
| JP | 8177440 | A | 7/1996 |

OTHER PUBLICATIONS

International Search Report and Written Opinion for corresponding Application No./Patent No. 10154681.0 - 1263/2305975, mailed Apr. 11, 2011, 6 pages.

* cited by examiner

*Primary Examiner* — Noah Kamen
(74) *Attorney, Agent, or Firm* — Julia Voutyras; Brooks Kushman P.C.

(57) ABSTRACT

The disclosure relates to an internal combustion engine having a cylinder head and cylinder block serving as an upper crankcase portion for holding a crankshaft in multiple bearings. The engine has an oil pump for feeding engine oil to the cylinder head prior to supplying the multiple bearings in the cylinder block.

20 Claims, 4 Drawing Sheets

HEATING ENGINE OIL IN AN INTERNAL COMBUSTION ENGINE

CROSS-REFERENCE TO RELATED APPLICATIONS

This application claims foreign priority benefits under 35 U.S.C. §119(a)-(d) to DE 10 2009 045 320.2, filed Oct. 5, 2009, which is hereby incorporated by reference in its entirety.

BACKGROUND

1. Technical Field

The disclosure relates to a system and method for heating engine oil of an internal combustion engine.

2. Background

Within the context of the present disclosure, the expression "internal combustion engine" encompasses diesel engines, spark-ignition engines and engines of any other suitable combustion mode.

Internal combustion engines typically have a cylinder block with a plurality of cylinders coupled to a cylinder head to form combustion chambers.

A piston is provided in each cylinder of an internal combustion engine guided in an axially movable manner within the cylinder or a cylinder liner. The cylinder liner, cylinder head and piston crown delimit the combustion chamber associated with one cylinder. The piston crown forms a part of the combustion chamber and, together with the piston rings, seals off the combustion chamber with respect to the crankcase to limit combustion gases from entering the crankcase and to limit oil passing into the combustion chamber.

The piston serves to transmit the gas forces generated by the combustion to the crankshaft. The piston is articulatedly connected by a piston pin to a connecting rod, which in turn is movably mounted on the crankshaft.

The crankshaft, which is mounted in the crankcase, absorbs the connecting rod forces, which are composed of the gas forces as a result of the fuel combustion in the combustion chamber and the mass forces as a result of the non-uniform movement of the engine parts. The reciprocating movement of the pistons is transformed into a rotating rotational movement of the crankshaft. The crankshaft transmits the torque to the drivetrain. A part of the energy transmitted to the crankshaft is used for driving auxiliary units such as the oil pump and the alternator, and/or serves for driving the camshaft and therefore for actuating the valve drive.

Generally, and within the context of the present disclosure, the upper portion of the crankcase is formed by the cylinder block. The crankcase is complemented by a lower crankcase portion which can be mounted on the upper crankcase portion and which serves as an oil pan. To hold the lower crankcase portion, the upper crankcase portion has a flange surface. In general, to seal off the oil pan or the crankcase with respect to the environment, a seal is provided in or on the flange surface. The connection between the crankcase portions is often provided by bolts.

To hold and mount the crankshaft, bearing saddles are formed in the upper crankshaft portion and one piece of a two-piece sleeve bearing is mounted in the bearing saddle. Typically, a bearing cap is coupled to the crankcase and the other part of the two-piece sleeve bearing is mounted in the bearing cap. The crankshaft is mounted in the region of the crankshaft journals which are arranged spaced apart from one another along the crankshaft axis and are generally formed as thickened shaft shoulders. In an alternative embodiment, the crankshaft rides directly upon the parent metal of the cylinder block and the bearing cap, i.e., without a separate sleeve bearing. The bearing surfaces in the bearing saddle and the bearing cap upon which the journal of the crankshaft rides is supplied engine oil to provide a load-bearing lubricating film.

To supply the bearings with oil, a pump for feeding engine oil to the at least two bearings is provided, with the pump supplying engine oil via a supply duct to a main oil gallery, from which ducts lead to the at least two bearings. In some engines, the supply duct leads from the pump through the cylinder block to the main oil gallery. To form the main oil gallery, a main supply duct is often provided which is aligned generally along the longitudinal axis of the crankshaft. The main supply duct may be arranged above or below the crankshaft in the crankcase or else may be integrated into the crankshaft.

An oil pump provides a sufficiently large feed flow at a sufficiently high oil pressure in the supply system, in particular to the main oil gallery. In some engines, a permanent oil supply to the at least two bearings is not supplied. In particular if the oil supply of the bearings is connected or interacts with a further oil supply for example via the main oil gallery, a permanent oil supply to the bearings is not supplied. Instead, a merely regular, but not continuous, oil supply to the bearings is supplied to limit pressure drop in the system.

Oil is supplied also to bearings associated with a camshaft. The camshaft may be cradled in a plurality of bearing saddles provided in the cylinder head and a plurality of bearing caps that couple to the cylinder head to hold the camshaft in place. The camshaft may ride on the parent material of the cylinder head and the bearing cap or upon a two-piece sleeve bearing provided in the bearing saddle and bearing cap.

An oil supply to bearings associated with the camshaft is supplied. The camshaft is also conventionally supplied with lubricating oil, for which purpose a supply duct is provided. In some systems, a duct branches off from the main oil gallery extending through the cylinder block and, in the case of overhead camshafts, and extending into the cylinder head.

Fuel consumption of the internal combustion engine is affected by the friction in the crankshaft and camshaft bearings. The friction depends on the viscosity, and therefore the temperature of the engine oil.

On account of the limited petroleum reserves, it is desirable to minimize fuel consumption in internal combustion engines. A lesser fuel consumption contributes also to lower emission of regulated pollutants as wells as carbon dioxide. It is desirable to raise the temperature of the lubricating oil quickly after a cold start of the engine to reduce friction.

SUMMARY

The internal combustion engine which is designed according to the disclosure has proven to be particularly advantageous during the warm-up phase, in particular after a cold start. After a standstill period of the vehicle, that is to say after a restart of the internal combustion engine, the oil flows firstly through the cylinder head which is heated comparatively quickly as a result of the combustion processes taking place, in particular in relation to the cylinder block. In this respect, the oil provided for the lubrication of the crankshaft bearings is also heated more quickly if, as per the approach according to the disclosure, it is conducted firstly through the cylinder head.

It should be noted that, in the internal combustion engine according to the disclosure, the engine oil may also be conducted through the cylinder block, for example if the supply duct to the main oil gallery is conducted from the cylinder head through the cylinder block.

Heated oil, or oil of a relatively high temperature, has a relatively low viscosity, which reduces the friction losses of the internal combustion engine and improves the efficiency. As a result, the fuel consumption of the internal combustion engine is noticeably reduced by heating the oil, in particular after a cold start.

Because the approach according to the disclosure does not add a heater, it presents an advantage over concepts in which additional components are required. Besides the extra cost, weight, and complexity of a heater, the heater consumes electrical energy, thereby partially offsetting any fuel advantage of rapid warming of the oil in the vicinity of the bearings.

In background systems, oil flows from the oil pump to the main gallery in the cylinder block and then to the cylinder head. According to the present disclosure, the oil flow is generally reversed in that the oil flows into the combustion chamber and then to the oil gallery in the cylinder block That part of the supply duct which extends through the at least one cylinder head is preferably designed with regard to its primary function, specifically that of heating oil.

Embodiments of the internal combustion engine are advantageous in which an oil pan which can be mounted on the upper crankcase portion and which serves as a lower crankcase portion is provided for collecting the engine oil, and the pump feeds engine oil originating from the oil pan via a supply duct to the main oil gallery.

In the embodiment, the crankcase is formed in two parts, with the upper crankcase portion being complemented by an oil pan in which the returned oil is collected. The oil pan may be equipped on the outside with cooling fins or stiffening ribs and may be produced from sheet metal in a deep drawing process, whereas the upper crankcase portion may be a cast part.

Typically, the cylinder block and the cylinder head have a cooling jacket.

The heat released during the combustion by the exothermic, chemical conversion of the fuel is dissipated partially to the cylinder head and cylinder block via the walls which delimit the combustion chamber and partially to the adjacent components and the environment via the exhaust-gas flow. To keep the thermal loading on the cylinder head within limits, some energy is extracted from the cylinder head.

On account of the significantly higher heat capacity of liquids than air, it is possible for significantly greater quantities of energy to be extracted using a liquid cooling arrangement than using an air cooling arrangement. A liquid-cooled cylinder head has coolant ducts to conduct coolant there through. The coolant ducts may be a complex structure in the cylinder head.

Embodiments of the internal combustion engine are advantageous in which the supply duct comprises at least two partial supply ducts along a part which extends through the at least one cylinder head.

In the embodiment, the supply duct forks into at least two partial supply ducts, that is to say splits into a plurality of partial supply ducts. This increases the overall surface area of the supply duct along a part extending through the at least one cylinder head, as a result of which the heat transfer between the cylinder head and the engine oil situated in the supply duct is assisted, that is to say increased. In the embodiment in question, therefore, the supply duct is optimized, at least along one part, with regard to its primary function in the cylinder head, specifically with regard to its function as a heat exchanger.

Here, the heat transfer between the cylinder head and the engine oil situated in the supply duct may relate both to the introduction of heat from the hot exhaust gas flow into the engine oil and also—in the case of liquid-cooled cylinder heads—to the introduction of heat into or extraction of heat from the engine oil by the coolant.

Here, the supply duct may split into two or more partial supply ducts in the cylinder head or else outside, that is to say upstream of, the cylinder head. The merging of the individual partial supply ducts to form a common supply duct may likewise take place in the cylinder head or downstream of the cylinder head.

In this context, embodiments of the internal combustion engine are advantageous in which the at least two partial supply ducts run parallel to one another at least in sections.

Embodiments of the internal combustion engine are advantageous in which the coolant jacket which is integrated in the at least one cylinder head also extends at least partially between the at least two partial supply ducts.

In the embodiment, the coolant jacket also extends between the at least two partial supply ducts. This in particular encompasses embodiments in which the coolant jacket passes through, that is to say intersects, an imaginary envelope placed around the at least two partial supply ducts.

The coolant jacket, or the coolant conducted through the cooling ducts, counteracts overheating and therefore premature aging of the engine oil, and prevents coking of the oil and the formation of depositions in the supply duct which would reduce the flow cross section or could lead to blockage of the duct.

Embodiments of the internal combustion engine are advantageous in which the at least one cylinder head comprises at least two cylinders, with each cylinder having at least one outlet opening for discharging the exhaust gases out of the cylinder and with each outlet opening being adjoined by an exhaust duct, with the exhaust ducts of at least two cylinders merging to form an overall exhaust duct within the at least one cylinder head, so as to form an integrated exhaust manifold.

The merging of exhaust ducts to form an overall exhaust duct is referred to generally, and within the context of the present disclosure, as an exhaust manifold.

An exhaust manifold integrated in the cylinder head has several advantages, which will be discussed briefly below.

Downstream of a manifold, the exhaust gases are often supplied to the turbine of an exhaust-gas turbocharger and/or to one or more exhaust-gas aftertreatment systems. Here, it is sought firstly to arrange the one or more exhaust-gas turbochargers as close as possible to the outlet of the internal combustion engine thereby to be able to optimally utilize the exhaust-gas enthalpy of the hot exhaust gases, which is determined significantly by the exhaust-gas pressure and the exhaust-gas temperature, and to ensure a fast response behavior of the turbocharger. Secondly, the path of the hot exhaust gases to the different exhaust-gas aftertreatment systems should be as short as possible such that the exhaust gases are given little time to cool down and the exhaust-gas aftertreatment systems reach their operating temperature or light-off temperature as quickly as possible, in particular after a cold start of the internal combustion engine.

For such reasons, it is therefore fundamentally sought to minimize the thermal inertia of the part of the exhaust duct between the outlet opening at the cylinder and the exhaust-gas aftertreatment system, or between the outlet opening at the cylinder and the exhaust-gas turbocharger or turbine, which may be achieved by reducing the mass and the length of the part.

To achieve the above-stated aims, the exhaust ducts are preferably merged within the cylinder head. The measure also permits the densest possible packaging of the drive unit.

Embodiments of the cylinder head having for example four cylinders in an in-duct arrangement, in which the exhaust ducts of the outer cylinders and the exhaust ducts of the inner cylinders merge in each case to form one overall exhaust duct, can also be used to form an internal combustion engine according to the disclosure of the type in question. The same applies to cylinder heads having three or more cylinders in which only the exhaust ducts of two cylinders merge to form an overall exhaust duct.

Embodiments are also advantageous in which the exhaust ducts of all the cylinders of the at least one cylinder head merge within the cylinder head to form a single, that is to say common overall exhaust duct.

A cylinder head with an integrated exhaust manifold is thermally more highly loaded than a conventional cylinder head which is equipped with an external manifold, and therefore places greater demands on the cooling arrangement, for which reason a liquid cooling arrangement is particularly advantageous in a cylinder head with integrated exhaust manifold.

Secondly, the integration of the manifold contributes to a further reduction in the friction losses of the internal combustion engine. This is in particular because, in the warm-up phase after a cold start of the internal combustion engine, a cylinder head with an integrated manifold reaches higher temperatures more quickly than a conventional cylinder head with an external manifold.

Consequently, it is advantageous for the manifold to be integrated into the cylinder head that the engine oil which is conducted through the cylinder head is heated as quickly as possible after a cold start.

A liquid cooling arrangement of the cylinder head advantageously serves to limit the upward temperature rise of the oil, and can if appropriate assist the heating of the oil in the warm-up phase.

Embodiments are advantageous in which the coolant jacket which is integrated in the at least one cylinder head also extends at least partially between the integrated exhaust manifold and the at least one supply duct. The arrangement of coolant jacket, manifold, and duct ensures that the engine oil does not overheat. The coolant jacket functions as a heat barrier at high exhaust-gas temperatures.

In the embodiment, the coolant jacket also extends between the integrated exhaust manifold and the at least one supply duct. This in particular encompasses embodiments in which the coolant jacket passes through an imaginary envelope surrounding the manifold and the supply duct.

Embodiments are advantageous in which the supply duct is connected to a camshaft receptacle to supply engine oil.

In the prior art, use is generally made of valves as control elements for the charge exchange, which valves are movable along their longitudinal axis between a valve closed position and a valve open position to open up and shut off an inlet or outlet opening. To actuate the valve, valve spring means are firstly provided to preload the valve in the direction of the valve closed position, and valve actuating devices are secondly used to open the valve counter to the preload force of the valve spring means.

Here, the valve actuating device comprises a camshaft on which a multiplicity of cams is arranged and which is set in rotation by the crankshaft—for example via a chain drive—in such a way that the camshaft rotates at portion the crankshaft rotational speed.

Use is often made of overhead camshafts, that is to say camshafts which are arranged above the assembly surface between the cylinder head and cylinder block and which are mounted in the cylinder head.

Overhead camshafts are mounted for example in two-part so-called camshaft receptacles. For this purpose, the camshaft has at least two bearing points, which are generally formed as thickened shaft shoulders. The camshaft receptacle comprises a lower part and an upper part in which the bearing saddles and bearing covers are arranged. The camshaft is held and mounted with its bearing points in the bearing saddles and bearing covers. Here, the bearings are supplied with engine oil such that a load-bearing lubricating film is formed as the camshaft rotates—similarly to a plain bearing.

In the embodiment in question, to supply the camshaft bearing with oil, the supply duct is connected to the camshaft receptacle. The supply of heated engine oil to the camshaft bearings via the supply duct reduces the friction in the bearings of the camshaft and further reduces the friction losses of the internal combustion engine. This applies both to the camshaft of the inlet valves, that is to say of the inlet side, and also for the camshaft of the outlet valves, that is to say of the outlet side.

The second partial object on which the disclosure is based, specifically that of specifying a method for heating the engine oil for an internal combustion engine of an above-stated type, is achieved by a method which is characterized in that, upstream of the at least two bearings, the engine oil is conducted through the at least one cylinder head.

That which has been stated in connection with the internal combustion engine according to the disclosure likewise applies to the method according to the disclosure.

BRIEF DESCRIPTION OF THE DRAWINGS

The disclosure is described in more detail below on the basis of three exemplary embodiments of the internal combustion engine as per FIGS. 1 to 3, in which.

DETAILED DESCRIPTION

As those of ordinary skill in the art will understand, various features of the embodiments illustrated and described with reference to any one of the Figures may be combined with features illustrated in one or more other Figures to produce alternative embodiments that are not explicitly illustrated or described. The combinations of features illustrated provide representative embodiments for typical applications. However, various combinations and modifications of the features consistent with the teachings of the present disclosure may be desired for particular applications or implementations.

Figure 1:
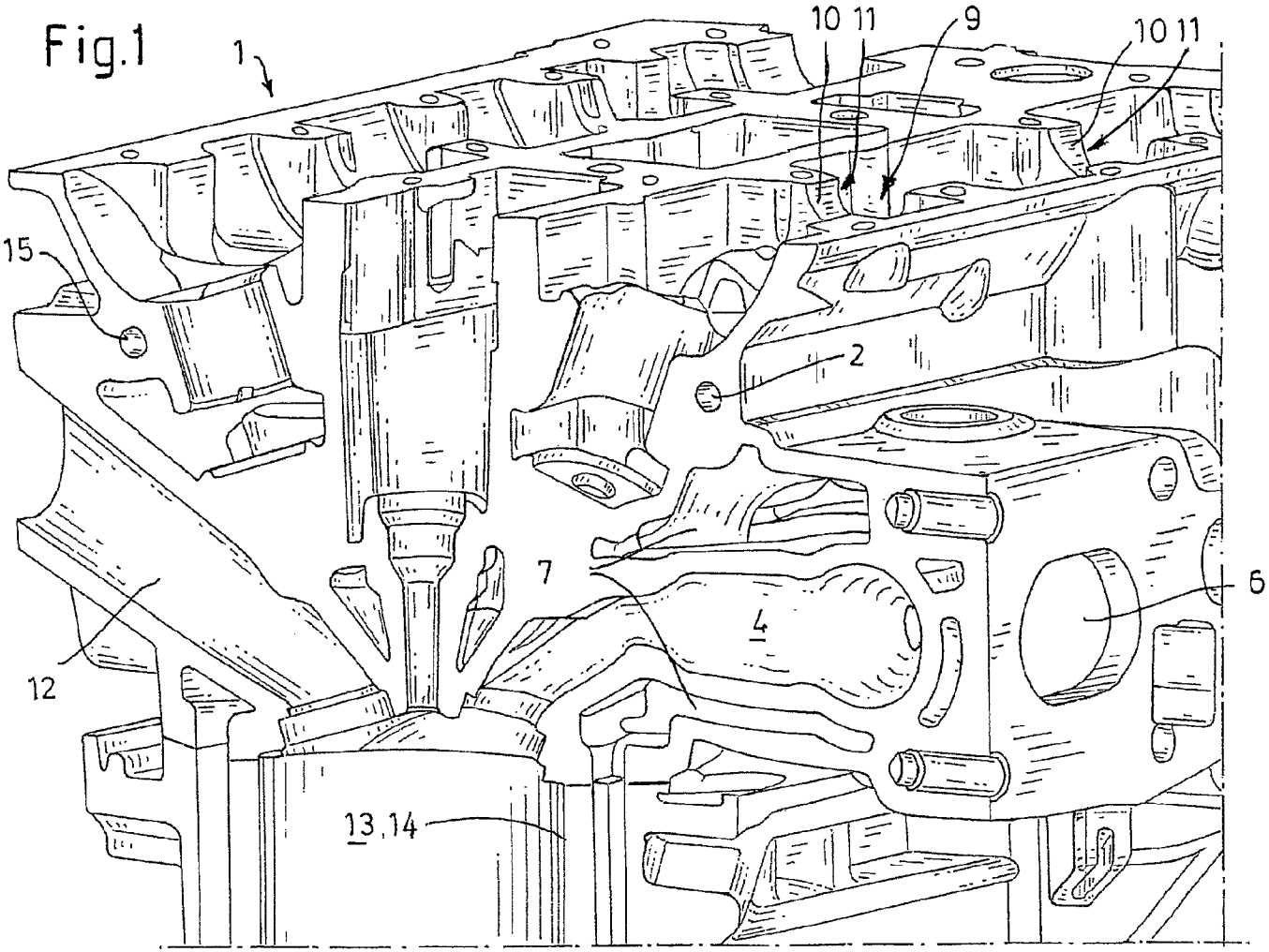
FIG. 1 shows a fragment of a cylinder head of a first embodiment of the internal combustion engine in a perspective illustration in cross section.

FIG. 1 schematically shows a fragment of a cylinder head 1 of an embodiment of the internal combustion engine in a perspective illustration, specifically in a section perpendicular to the longitudinal axis of the cylinder head 1.

The cylinder head 1 has a plurality of cylinders 14 in an in-line arrangement. NOT CORRECT The combustion chamber 13 of each cylinder 14 is supplied with fresh mixture or fresh air via two intake ducts 12. Two exhaust ports per cylinder 14 serve for discharging the exhaust gases, with each exhaust port being adjoined by an exhaust duct 4. The exhaust ducts 4 of all the cylinders 14 merge to form an overall exhaust duct 6 within the cylinder head 1, so as to form an integrated exhaust manifold. Alternatively, an exhaust manifold is coupled to the cylinder head 1.

The cylinder head 1 illustrated in FIG. 1 is liquid-cooled. To form the liquid-cooling arrangement, the cylinder head 1 is equipped with an integrated coolant jacket 7 which conducts coolant 8 through the cylinder head 1. Here, the coolant jacket 7 comprises a coolant jacket 7 which is arranged above the exhaust manifold 5, that is to say on the side of the exhaust manifold (including 4 and 6) facing away from the cylinder block, and a coolant jacket 7 which is arranged below the exhaust manifold 5, that is to say on the side of the manifold 5 facing toward the cylinder block, and which merges into the cylinder block.

A supply duct 2 extends through the cylinder head 1 along the longitudinal axis of the cylinder head 1. The duct 2 serves for supplying engine oil (not illustrated) to the bearings of a crankshaft which is held in the crankcase, and the duct 2 runs above the coolant jacket 7, that is to say the duct 2 is arranged on that side of the coolant jacket 7 which faces away from the exhaust manifold 5.

In the cylinder head 1 illustrated in FIG. 1, the supply duct 2 also serves for supplying oil 3 to the camshaft bearings 10 on the outlet side. Each bearing 10 comprises a bearing saddle 11 and a bearing cover.

For this purpose, the supply duct 2 is connected to the camshaft receptacle 9 (not illustrated). The supply of heated engine oil to the camshaft bearings 10 via the supply duct 2 reduces the friction in the bearings 10 of the camshaft. The same applies analogously to the bearings of the crankshaft.

It is also possible to see the camshaft receptacle for the camshaft of the inlet valves, and a further duct 15 which runs along the longitudinal axis of the cylinder head 1 and supplies lubricating oil to the camshaft bearing on the inlet side.

Figure 2:
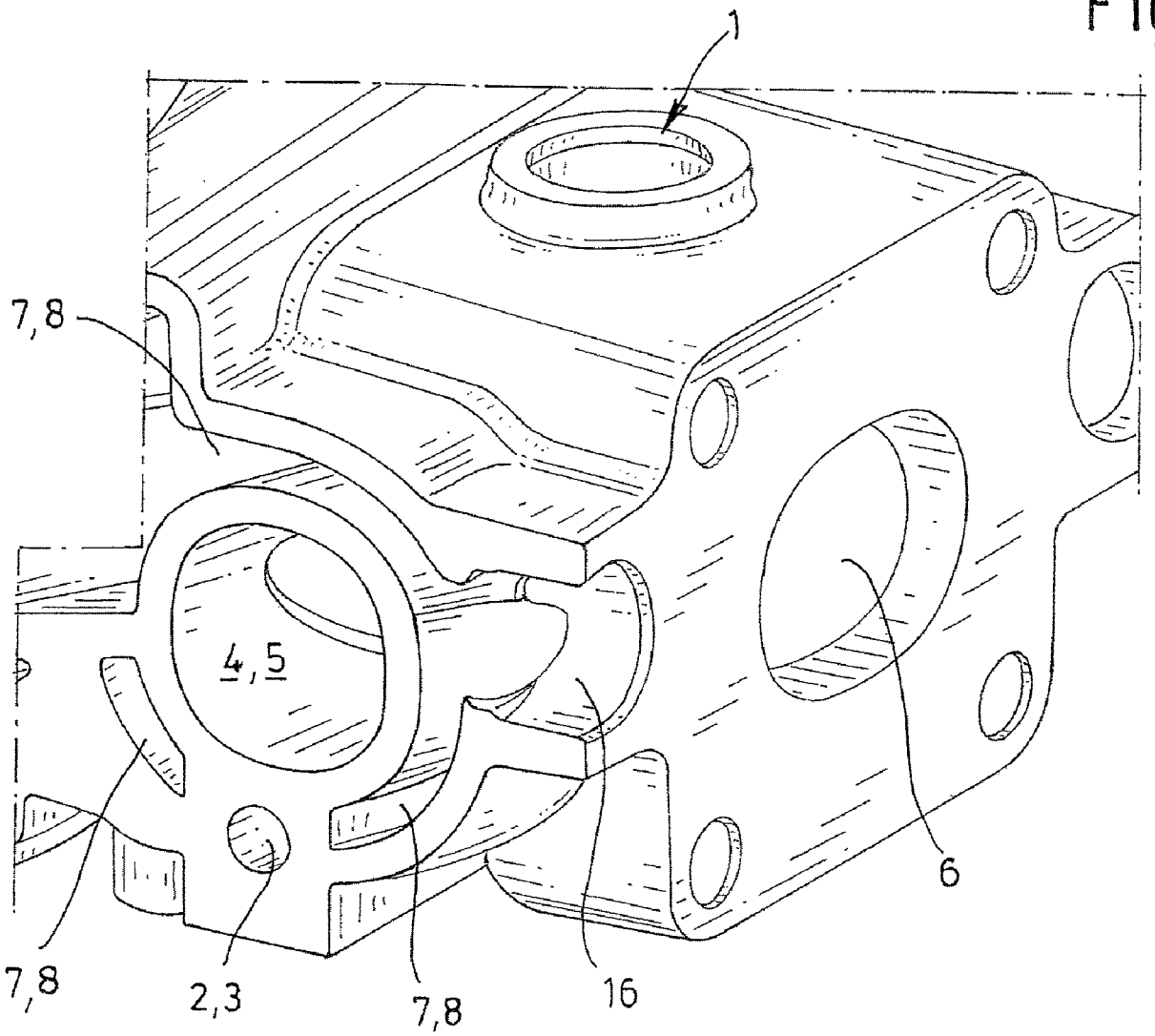
FIG. 2 shows a fragment of a cylinder head of a second embodiment of the internal combustion engine in a perspective illustration in cross section.

FIG. 2 schematically shows the fragment of a cylinder head 1 of a second embodiment of the internal combustion engine in a perspective illustration, specifically in a section perpendicular to the longitudinal axis of the cylinder head 1.

It is sought to discuss the differences in relation to the embodiment illustrated in FIG. 1, for which reason reference is otherwise made to FIG. 1. The same reference numerals have been used for the same components.

The coolant jacket 7 which is integrated in the cylinder head 1 to form a liquid cooling arrangement is arranged substantially above the exhaust manifold 5, that is to say on the side of the manifold 5 facing away from the cylinder block (not illustrated), and extends around the manifold 5 to the underside of the manifold 5. The coolant jacket 7 is interrupted by the supply duct 2 on the underside of the manifold 5, that is to say the coolant jacket 7 runs at both sides of the duct 2 and has an opening 16 which is provided adjacent to the overall exhaust duct 6 on a longitudinal side of the cylinder head 1 and which is closed off in the assembled state of the head 1. The opening 16 is formed for production reasons, and serves to allow subsequent machining of the coolant jacket 7 to be carried out. The opening 16 may nevertheless also remain open for the extraction of coolant, for example for the supply of coolant to a liquid-cooled turbocharger.

In the embodiment illustrated in FIG. 2, the supply duct 2 runs on that side of the manifold 5 which faces toward the cylinder block (not illustrated), that is to say on the underside of the manifold 5, with no part of the coolant jacket extending between the manifold 5 and the supply duct 2 in the illustrated section, such that heat can be transferred unhindered from the exhaust-gas flow to the engine oil.

Figure 3:
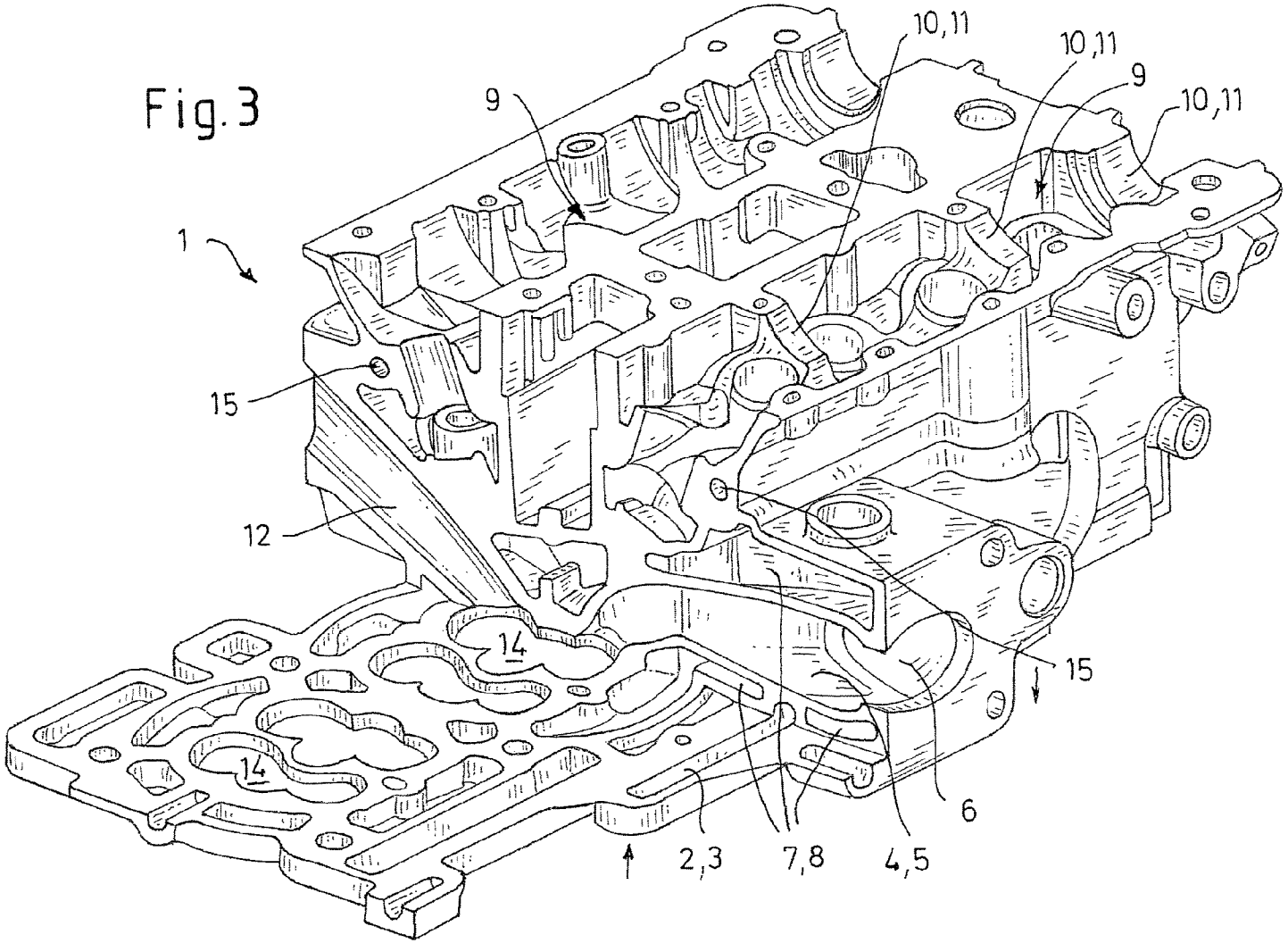
FIG. 3 shows a fragment of a cylinder head of a third embodiment of the internal combustion engine in a perspective illustration in cross section and longitudinal section.

FIG. 3 schematically shows the fragment of a cylinder head 1 of a third embodiment of the internal combustion engine in a perspective illustration, specifically in a section perpendicular to the longitudinal axis of the cylinder head 1 and in the direction of the longitudinal axis.

It is sought to discuss only the differences in relation to the embodiments illustrated in FIGS. 1 and 2, for which reason reference is otherwise made to FIGS. 1 and 2. The same reference numerals have been used for the same components.

In the cylinder head 1 illustrated in FIG. 3—as in the embodiment illustrated in FIG. 2—the supply duct 2 runs along the longitudinal axis of the cylinder head 1 on that side of the manifold 5 which faces toward the cylinder block (not illustrated), that is to say on the underside of the manifold 5. The manifold 5 and the supply duct 2 are not separated from one another by a coolant jacket in the illustrated section. Proceeding from the cylinder block, the supply duct 2 enters into the cylinder head 1 at the underside of the head 1, that is to say at the assembly end surface, and leaves the cylinder head 1 at the underside again at the other end of the duct 2, where it enters into the block again (denoted by arrows).

The coolant jacket 7 which is integrated in the cylinder head 1 to form a liquid cooling arrangement runs both above the exhaust manifold 5, that is to say on the side of the manifold 5 facing away from the cylinder block (not illustrated), and also on the underside of the manifold 5. On the underside of the manifold 5, the coolant jacket 7 is interrupted—as in FIG. 2—by the supply duct 2, that is to say the coolant jacket 7 runs at both sides of the duct 2.

The camshaft receptacle 9 for the outlet camshaft is arranged on the side of the manifold 5 facing away from the cylinder block. A further duct 15 serves for supplying lubricating oil to the camshaft bearings 10. Each bearing 10 comprises a bearing saddle 11 and a bearing cover (not illustrated).

The camshaft receptacle 9 for the camshaft of the inlet valves is arranged opposite, that is to say on the inlet side, and the camshaft receptacle 9 is likewise supplied with lubricating oil via a further duct 15.

Figure 4:
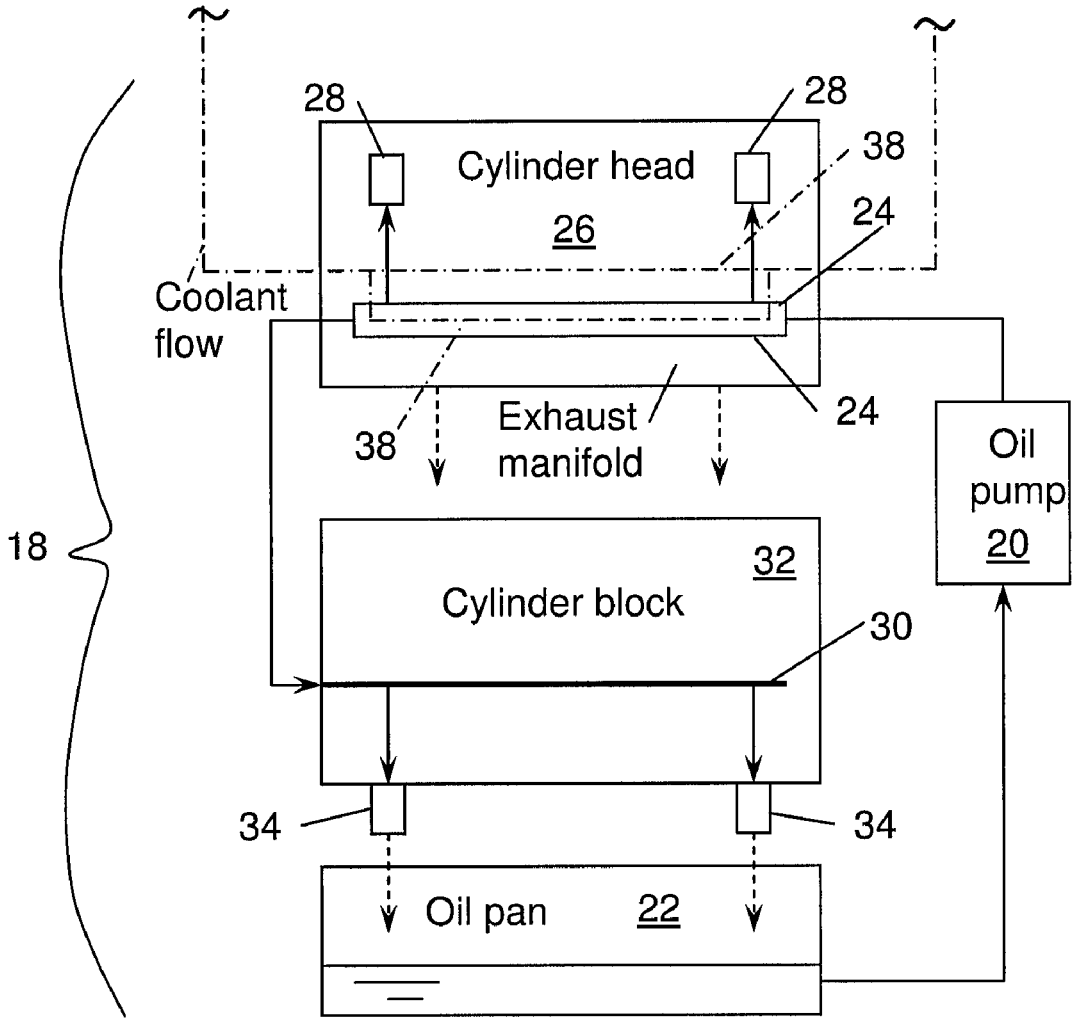
FIG. 4 is a schematic representation of flow paths of coolant and oil through the engine according to an embodiment of the disclosure.

A schematic representation of one embodiment of oil and coolant flow through an engine 18 is shown in FIG. 4. An oil pump 20 draws oil out of an oil pan 22 and provides the oil to passages 24 within cylinder head 26. Cylinder head 26 has an integrated exhaust manifold.

Passages 24 may run roughly parallel through cylinder head 26 and within the exhaust manifold portion of cylinder head 26 for fast warmup of the oil. Oil is provided to camshaft bearing saddles 28 from passages 24. Oil from passages 24 is also provided to main oil gallery 30 in cylinder block 32. Oil from main oil gallery 30 is provided to main bearing saddles 34.

In FIG. 4, for schematic purposes, engine 18 is shown exploded. In reality, oil pan 22 and cylinder head 26 are coupled to cylinder block 32. The passages for oil and coolant within cylinder head 26 and cylinder block 32 typically are internal to engine 18. Oil drainbacks 36 allow oil to drain back to oil pan 22 under the force of gravity. Oil from bearing saddles 28, 34 seep out and pass through drain holes (not shown) in cylinder head 26 and cylinder block 32 to oil pan 22.

A cooling jacket is typically provided in both cylinder head 26 and cylinder block 32. For the purposes of the present disclosure, only coolant passages 38 are shown in cylinder head 26. Engine 18 is typically provided with a complete coolant circuit; but, only a small portion of such circuit is shown in FIG. 4.

Figure 5:
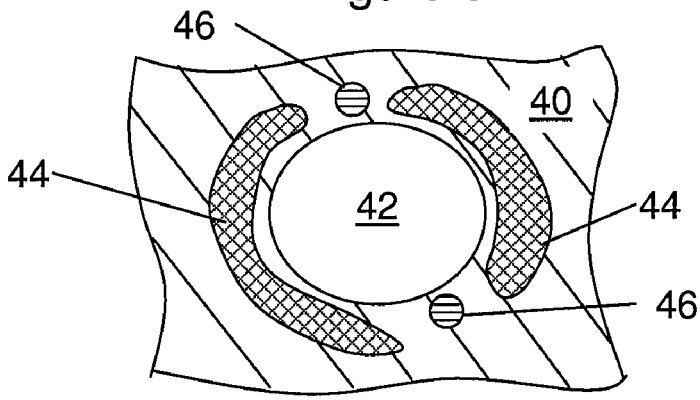
FIG. 5 is a schematic representation of coolant and oil passages adjacent an exhaust duct.

Oil passages 24 are shown to be parallel with water passages 38 in FIG. 4. Due to the two-dimensional nature of the drawing, they appear to be alongside each other. In FIG. 5, one example configuration of a portion of a cylinder head 40 is shown in cross section in the vicinity of an exhaust duct 42. Two water jacket sections 44 are shown partially surrounding exhaust duct 42. Oil passages 46 are provided proximate to exhaust duct 42 as well as proximate water jacket sections 44. Oil passages 46 proximate exhaust duct 42 aid in bringing oil up to temperature quickly after a cold start of the engine. However, it is also desirable to control the temperature of the oil so that it does not coke. By having oil passages 46 also proximate water jacket sections 44, the temperature of the oil in passages 46 is controlled.

While the best mode has been described in detail, those familiar with the art will recognize various alternative designs and embodiments within the scope of the following claims. Where one or more embodiments have been described as providing advantages or being preferred over other embodiments and/or over background art in regard to one or more desired characteristics, one of ordinary skill in the art will recognize that compromises may be made among various features to achieve desired system attributes, which may depend on the specific application or implementation. These attributes include, but are not limited to: efficiency, direct cost, strength, durability, life cycle cost, packaging, size, weight, serviceability, manufacturability, ease of assembly, marketability, appearance, etc. The embodiments described as being less desirable relative to other embodiments with respect to one or more characteristics are not outside the scope of the disclosure as claimed.

What is claimed:

1. An internal combustion engine comprising:

at least one cylinder head;

at least one cylinder block, which can be connected to the at least one cylinder head and which serves as an upper crankcase portion, for holding a crankshaft in at least two bearings; and a pump for feeding engine oil to the at least two bearings via a duct extending through the cylinder head upstream of a main oil gallery.

2. The engine of claim 1 wherein an oil pan which is mounted on the upper crankcase portion and which serves as a lower crankcase portion is provided for collecting the engine oil, and the pump feeds engine oil originating from the oil pan via a supply duct to the main oil gallery.

3. The engine of claim 1 wherein the at least one cylinder head is equipped with a coolant jacket which is at least partially integrated in the cylinder head.

4. The engine of claim 1 wherein the supply duct comprises at least two partial supply ducts along a part which extends through the at least one cylinder head.

5. The engine of claim 4 wherein the at least two partial supply ducts run parallel to one another at least in sections.

6. The engine of claim 1 wherein:

the at least one cylinder head comprises at least two cylinders, with each cylinder having at least one exhaust port for discharging the exhaust gases out of the cylinder and each exhaust port adjoined by an exhaust duct;

the exhaust ducts of at least two cylinders merging to form an overall exhaust duct within the at least one cylinder head to form an integrated exhaust manifold; and the supply duct is proximate one of the overall exhaust duct and the exhaust ducts.

7. The engine of claim 1 wherein the supply duct is connected to a camshaft receptacle to supply engine oil.

8. An internal combustion engine, comprising:

a cylinder head;

a cylinder block coupled to the cylinder head;

at least two bearing saddles in the cylinder block;

an oil pump for supplying engine oil through a supply duct in the cylinder head to a main oil gallery from which ducts lead to the at least two bearing saddles.

9. The engine of claim 8 wherein the cylinder block forms an upper crankcase portion, the engine further comprising:

an oil pan mounted on the upper crankcase portion and serving as a lower crankcase portion for collecting the engine oil, the oil pump feeds engine oil originating from the oil pan.

10. The engine of claim 8, further comprising: a cooling jacket in the cylinder head.

11. The engine of claim 8 wherein the supply duct comprises at least two partial supply ducts extending through the cylinder head.

12. The engine of claim 11 wherein the at least two partial supply ducts run generally parallel to one another at least in sections.

13. The engine of claim 12, further comprising: a cooling jacket in the cylinder head with the cooling jacket located substantially between the at least two partial supply ducts.

14. The engine of claim 8 wherein the cylinder head comprises at least two cylinders, with each cylinder having at least one exhaust port for discharging the exhaust gases out of the cylinder and with each exhaust port being adjoined by an exhaust duct, with the exhaust ducts of at least two cylinders merging to form an overall exhaust duct within the cylinder head to form an integrated exhaust manifold.

15. The engine of claim 8 wherein the cylinder head includes at least one exhaust duct and the supply duct in the cylinder head is proximate the exhaust duct, the engine further comprising:

a water jacket in the cylinder head wherein at least a portion of the water jacket is proximate the exhaust duct.

16. An oil supply system for an internal combustion engine, comprising:

an oil pan;

an oil pump pumping oil from the oil pan to a supply duct in a cylinder head of the engine;

a main oil gallery disposed in a cylinder block of the engine wherein the main oil gallery is supplied oil from the supply duct in the cylinder head.

17. The system of claim 16 wherein the cylinder head has an exhaust duct and the supply duct in the cylinder head is proximate the exhaust duct.

18. The system of claim 16 wherein the cylinder head comprises at least two cylinders, with each cylinder having at least one exhaust port for discharging the exhaust gases out of the cylinder and with each exhaust port being adjoined by an exhaust duct, with the exhaust ducts of at least two cylinders merging to form an overall exhaust duct within the cylinder head to form an integrated exhaust manifold and the supply duct in the cylinder head is proximate the overall exhaust duct for at least a portion of the supply duct.

19. The system of claim 16 wherein the supply duct also supplies oil to camshaft bearings in the cylinder head.

20. The system of claim 19 wherein oil is returned to the oil pan from the camshaft bearings and the crankshaft bearing by gravity feed.

* * * * *